United States Patent [19]

Polselli et al.

[11] 4,406,488

[45] Sep. 27, 1983

[54] QUICK RELEASE DOOR LOCK

[76] Inventors: Rudolph T. Polselli, 213 Craft Ridge Ave.; Luigi Polselli, 230 Parkway Blvd., both of Broomall, Pa. 19008

[21] Appl. No.: 337,429

[22] Filed: Jan. 6, 1982

[51] Int. Cl.[3] ..... E05C 19/18

[52] U.S. Cl. ..... 292/293

[58] Field of Search ..... 292/291, 293, 294, 289, 292/295, 296

[56] References Cited

U.S. PATENT DOCUMENTS

| | | | |
|---|---|---|---|
| 196,810 | 11/1877 | Kerlicks | 292/293 |
| 789,747 | 5/1905 | Love | 292/294 |
| 1,171,266 | 2/1916 | Simmons | 292/293 |
| 1,833,710 | 11/1931 | Gearhart | 292/291 |
| 4,200,317 | 4/1980 | Polselli et al. | 292/293 |

*Primary Examiner*—Richard E. Moore

*Attorney, Agent, or Firm*—Karl L. Spivak

[57] ABSTRACT

A quick release door lock is disclosed which includes a unitary body of thin, flat, hardened steel. The body terminates at one end in an integral tongue and at the other in an integral bent flange. A unitary, generally U-shaped slide is movable along the body between door engaging and door releasing positions in response to the movements of an operating rod. The operating rod is reciprocal and rotatable through the flange and is provided with an unthreaded adjusting section and a threaded securing section. The threaded section is designed with a double lead special thread to provide increased linear movement of the slide in response to rotation of the operating rod. The tongue is a removable fit within the door jamb recess and the slide is movable into engagement with the door to secure the door at the jamb between the body tongue and a pressure face of the slide.

9 Claims, 2 Drawing Figures

QUICK RELEASE DOOR LOCK

BACKGROUND OF THE INVENTION

The invention relates generally to the field of door locks, and more particularly, is directed to a lightweight, portable lock designed to permit the rapid locking and unlocking of most swinging type door constructions from inside of the premises.

In view of the increased number of reported instances of unlawful entry and break-ins in homes, businesses, hotel rooms and motel rooms, it has become increasingly important to find a reliable means for locking doors to protect the lives and property of the lawful occupants while they are within the building.

Prior workers in the art have developed portable door fasteners or locks of the general type forming the subject matter of the present invention in an effort to provide an inexpensive, portable device suitable to secure a door from the inside to discourage unauthorized entry. The device of our earlier invention, U.S. Pat. No. 4,200,317 is exemplary of prior art portable locking systems designed for door securing purposes.

The prior portable locks usually comprise generally an enlongate body which terminates at one end in a door keeper recess engagement means and at the other end in a threaded socket. An operating bolt is threadedly engaged in the socket to reciprocally move a slide or block along the body. The slide is forwardly moved to a door engaging position and is rearwardly pulled to a door releasing position, whereby the portable lock is usually compatible for use with most existing swinging door constructions.

While the above-mentioned patent and the patents cited therein employ the same general operating concept as the present invention, all of the devices of which we are aware are relatively slow in operation and quite costly in production, thereby discouraging widespread acceptance of such portable locking systems.

SUMMARY OF THE INVENTION

The present invention relates generally to the field of portable door fastener devices, and more particularly, is directed to a door locking system that is portable in nature and capable of rapidly securing and releasing a swinging door from the inside.

The quick release door lock of the present invention comprises generally an operating bolt, a slide and a unitary, flat, thin, elongated body which terminates forwardly in an integral, bent, keeper recess engaging tongue and at the rearward end in an integral bent flange. The flange is bent away from the body in a direction opposite from the tongue. The flange is provided with an opening and a threaded block to threadedly engage a threaded portion of the operating bolt.

The operating bolt is bent at one end to form a crank and includes a rearwardly positioned securing section adjacent to the crank. The securing section is formed with a special thread of increased pitch to facilitate quick release and quick locking of the portable door lock of the present invention. The operating bolt also includes an unthreaded adjusting section adjacent to securing section, the adjusting section being fabricated to a diameter that is small enough to slide freely through the threaded opening defined in the flange and block without frictional engagement.

The slide is movable relative to the body and preferably is formed of a single length of bent steel to provide adequate strength while at the same time minimizing construction and fabrication costs. One end of the operating bolt is secured for rotation in the slide, for example by employing a suitable C-clip, to permit the crank to turn the bolt relative to the slide in an extremely inexpensive and easily assembled construction.

It will be noted that the operating bolt forwardly connects to the slide in an extremely simple bearing connection whereby the adjusting bolt can be rotated and the slide can be advanced or retracted along the first body when the rearwardly positioned bent crank is rotated. The slide is movable relative to the flat body upon impetus of the connected operating bolt and is bent to provide a planar stop surface which can be brought into face-to-face contact with an edge portion of the door interior surface when the door is locked in the closed position. The slide is generally U-shape in cross section and includes angularly bent fingers which preferably are integral to reduce production costs. The fingers press against exposed interior portions of the lock keeper to additionally secure the locking construction.

The unthreaded adjusting section of the operating bolt allows the bolt to slide longitudinally relative to the body flange without engaging the threads so that the slide may be quickly moved along the thin body close to contact with the surface of the door edge without requiring rotation of the operating bolt. In this manner, the quick release door lock may be quickly applied to any door of any usual thickness to thereby render the quick release door lock of the present invention rapidly universal in application with substantially all doors of common construction. By moving the unthreaded adjusting section of the operating bolt through the threaded flange until the slide almost contacts the door surface, the adjustable portion of the bolt is quickly taken up without requiring any lost time for threadedly turning the crank. When the threads of the bolt securing section contact the flange threaded opening, the bolt crank must then be turned to advance the slide into contact with the door surface.

The threaded securing section of the operating bolt is provided with special threads for quick advance and release once the threads engage the flange opening. The securing section is positioned on the bolt for engagement with the flange threads when the slide is brought into the vicinity of the door. The special threads are fabricated of increased pitch and function to quickly tighten the slide against the door to maintain the door in a locked position. The special threads, due to the increased pitch, also facilitate rapid removal of the device for door unlocking when it is desired to open the door.

It is therefore an object of the present invention to provide an improved quick release door lock of the type set forth.

It is another object of the present invention to provide a novel door lock including a thin, flat, elongated slide body of unitary construction that is bent at one end to form a keeper engaging tongue and bent at the other end to provide a flange, a unitary, bent slide engagable and slidably retained on the thin body to press against the door for locking purposes, and an operating bolt to move the slide, the operating bolt including an unthreaded adjusting section and a specially threaded securing section, the special threads allowing rapid locking and unlocking of the door.

It is another object of the present invention to provide a novel quick release door lock that is portable in nature and of relatively small dimensions whereby the device may be easily transported by a traveler as an additional door securing lock when away from home, for example when in a hotel or motel room.

It is another object of the present invention to provide a novel door lock that is portable in nature and adapted for use with horizontal pivoting door constructions, the lock being fabricated of unitary lengths of thin, strong steel, which parts are bent to the proper configurations in a manner to greatly reduce production costs.

It is another object of the present invention to provide a novel quick release door lock that may be readily affixed to a door and jamb construction and which may be quickly detached therefrom without the need to employ special fasteners, keys or other tools.

It is another object of the present invention to provide a novel quick release door lock that is simple in construction, lightweight in design and quickly applicable when in use.

Other objects and a fuller understanding of the invention will be had by referring to the following description and claims of a preferred embodiment thereof, taken in conjunction with the accompanying drawings, wherein like reference characters refer to similar parts throughout the several views and in which:

DESCRIPTION OF THE PREFERRED EMBODIMENT OF THE INVENTION

Figure 1:
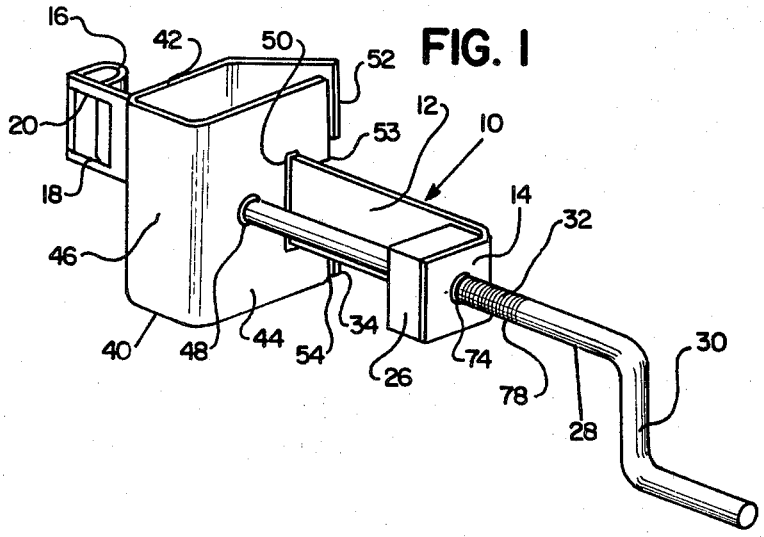
FIG. 1 is a perspective view of the quick release door lock of the present invention.

Although specific terms are used in the following description for the sake of clarity, these terms are intended to refer only to the particular structure of the invention selected for illustration in the drawings, and are not intended to define or limit the scope of the invention.

Referring now to the drawings, there is illustrated a quick release door lock generally designated 10 which comprises generally a slide body 12, a slide 40 movable along the body and an operating bolt 20 to control the movement of the slide. The body 12 comprises a thin, strong, planar construction of suitable strong material, for example hardened tool steel. Preferably, the body 12 is fabricated of relatively thin cross sectional thickness, for example 1/16th of an inch, to easily fit within the space defined between the front edge 70 of a door 56 and the adjacent face 72 of the associated door jamb 64.

The body 12 terminates rearwardly in an integral, bent flange 14, which flange is bent to extend at right angles to the planar face of the body 12. In the embodiment illustrated, the flange 14 is equipped with a rectangular metallic block 26 which includes a threaded opening 74 to receive the operating bolt 28 therethrough as hereinafter more fully set forth. The block 26 is fabricated to substantially the same configuration as the flange 14 and is affixed thereto in secure, rapid manner, for example by spot welding whereby the flange 14 and the metallic block 26 form a unitary, strong, inexpensive, threaded construction.

Figure 2:
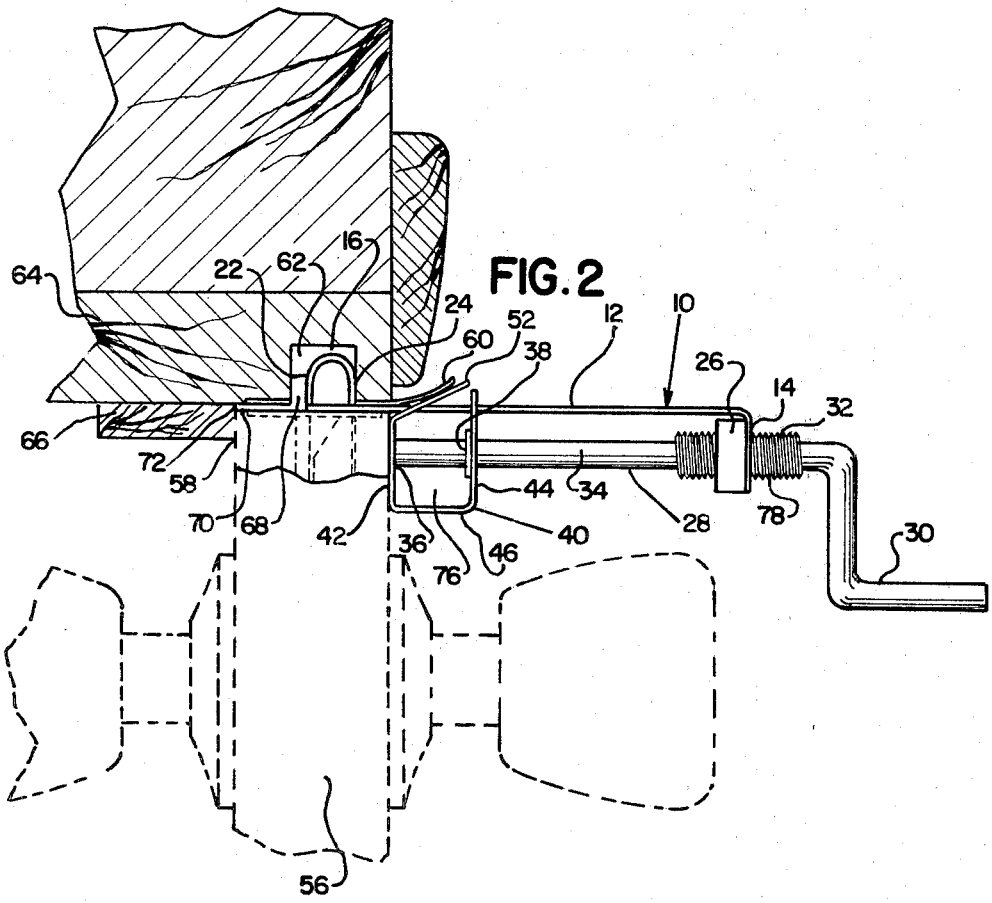
FIG. 2 is a top plan view showing the quick release door lock applied to lock a door.

The other or forward end of the body 12 is punched, cut or otherwise treated to provide a pair of spaced, laterally positioned, longitudinal cuts 18, 20 to define a bendable section therebetween, the bendable section being bent oppositely from the bent flange 14 to form an extending tongue 16. The tongue is generally U shaped in consideration, and as best seen in FIG. 2 includes a relatively flat securing face 24, which face extends at substantially right angles to the plane of the body 12. A bent face 22 integrally extends from the securing face 24 and preferably terminates flush with the body 12. The tongue 16 is formed of a size suitable to fit within a door jamb recess 62 for door securing purposes in the manner hereinafter more fully explained.

The slide 40 is engaged in longitudinal sliding relation with the body 12 as urged by the operating bolt 28 for locking and unlocking a door 56. Preferably, the slide 40 is fabricated of a unitary sheet of thin, strong steel which can be punched, die cut or otherwise formed and then bent to the desired configuration to thereby provide a sturdy, inexpensive and lightweight construction member. The slide 40 is generally U-shaped in cross sectional configuration and includes a bottom web 46, and integral, upwardly extending sides which include a pressure face 42 and a bearing face 44. A slot 50 is provided in the bearing face 44 for receipt of the body 12 therethrough. The pressure face 42 is designed to press against the inside or interior face 58 of the door 56. As illustrated, the pressure face 42 is cut or otherwise treated to provide a pair of spaced, angularlly extending fingers 52, 54, which fingers define therebetween an open area 53 to slidingly receive the body 12. The angular orientation of the fingers 52, 54 allows cooperation with the generally offset orientation of the exposed portion of the lock strike plate 60 to thereby interact and form a secure interconnection when the lock is in place.

The bearing face 44 is provided with an opening 48 to receive therethrough a forward portion of the operating bolt 28. Preferably, the adjusting section 34 of the operating bolt 28 is undercut to form a groove immediately behind the bearing face 44 to receive therein a securing device, such as C-clip 38 to retain the forward portion of the bolt 28 within the space 76 defined between the pressure face 42 and bearing face 44. The forward end or nose 36 of the operating bolt 28 terminates at and presses against the interior surface of the pressure face 42 for reinforcement purposes and to maintain the spacing between the spaced slide faces 42, 44 under all conditions of use.

The operating bolt 28 is preferably formed of a single length of bolt stock and includes generally a first or crank section 30, a second or securing section 32 and a third or adjusting section 34. The adjusting section 34 is cylindrical in configuration of diameter to readily slide within the opening defined within the threaded block 26 whereby the slide 40 can be rapidly moved toward or away from the door 56 when the device is in use. The securing section 32 comprises a special thread 78 to facilitate quick engagement and quick release of the locking device 10. Preferably, the threads 78 are formed of sufficient pitch to cause approximately one inch of slide travel upon every four or five revolutions of the crank 30. In a preferred embodiment, a 5/16"-18 double lead special thread has been successfully employed in combination with a ¼" diameter adjusting section. In this manner, the lock 10 can be quickly applied to a door 56 and can be rapidly removed therefrom whenever so desired. As illustrated, the unthreaded or adjusting section 34 is approximately three times as long as the securing section 32 so that most of the relative movement between the slide 40 and the body 12 can be rapidly made without the need to turn the crank 30. It has been observed that ordinary threads usually required between ten and fifteen turns of the bolt to effect door locking or release, a time consuming operation, The extraordinary number of revolutions required by the prior art designs made them awkward to handle and generally unacceptable when in use.

In order to use the quick release door lock 10 of the present invention, the slide 40 is first moved along the body 12 to its rearwardmost position wherein the bearing face 44 will be positioned substantially adjacent to the threaded block 26. The tongue 16 can then be rather readily inserted into the latch space or recess 62 defined behind the opening 68 provided in the usual lock strike plate 60. The securing face 24 of the tongue 16 is positioned against the interior facing surface of the recess 62 and strike plate opening 68 in bearing relationship thereto. With the slide 40 still pulled rearwardly adjacent to the block 26, the door 56 can then be urged to the closed position as illustrated to secure the tongue 16 within the recess 62. The body 12 can be moved or angularly offset as necessary to permit the door edge 70 to close past the body 12 the body is squeezed between the face 72 of the door jamb 64 and the door edge 70. In the closed and locked position, the door stops against the usual stop molding 66.

With the door 56 closed, as illustrated in FIG. 2, the body 12 will then extend interiorly substantially at right angles to the face of the door. The operating bolt 28 can then be forwardly urged by pushing the unthreaded adjusting section 34 through the threaded opening in the block 26 to urge the slide 40 toward the door 56. The length of the adjusting section 34 is designed so that the securing section threads 78 engage within the threaded opening of the block 26 before the slide pressure face 42 reaches the closing face 58 of the door 56.

Once the threads 78 touch the threaded opening within the block 26, all further inward movement of the slide 40 will be controlled by the crank 30 which is then turned to engage the operating bolt special thread 78 upon the threads of the threaded opening in the block 26. By rotating the crank 30, the engagement of the securing section threads 78 within the threaded bolt 26 urges the operating bolt 28 forwardly. This in turn presses the end or nose 36 of the adjusting bolt against the interior face of the slide pressure face 42 to force the slide against the door for locking purposes. As above set forth, the special thread 78 is designed to provide approximately one inch of slide movement for every four or five turns of the crank, thereby assuring very rapid locking and unlocking of the door. To open the door 56, the steps are simply reversed.

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claimed is:

1. A portable, quick release lock for a swinging door comprising an elongate, thin, planar, unitary body providing a slide path intermediate its ends, one end being bent from the plane of the body through approximately ninety degrees to define an integral flange, the flange being provided with a threaded opening, the other end being bent from the plane of the body to define an integral tongue, the tongue and the flange extending in opposite directions from the plane of the body;

an integral slide movable along the body between its ends, the slide comprising a pressure face adapted to contact the door and a bearing face spaced from the pressure face; and an operating bolt longitudinally and rotatively movable within the threaded opening, the bolt being adjusted to move the slide along the body toward and away from the door, the operating bolt being of unitary construction and comprising a crank, a threaded securing section and an unthreaded adjusting section, the adjusting section terminating in a pressure end, the pressure end being adapted to bear against the pressure face of the slide to press the slide against the door when the securing section is engaged within the threaded opening.

2. The lock of claim 1 wherein the threads of the securing section are formed with sufficient pitch to provide approximately one inch of slide travel for each five revolutions of the crank.

3. The lock of claim 1 wherein the slide is generally U-shaped in configuration and comprises an integral web joining the pressure face and the bearing face.

4. The lock of claim 3 wherein the bearing face is provided with an opening to receive the end of the operating bolt therethrough.

5. The lock of claim 4 and a bearing means intermediate the bearing face and the operating rod to secure the operating rod to the slide.

6. The lock of claim 5 wherein the bearing means comprises an undercut groove in the adjusting section and a clip secured in the groove.

7. The lock of claim 6 wherein the clip is positioned in the space defined between the pressure face and the bearing face.

8. The lock of claim 1 wherein the slide pressure face endwardly bifurcates to form a pair of spaced fingers.

9. The lock of claim 8 wherein the fingers are angularly bent from the plane of the pressure face towards the bearing face.

* * * * *